US005934391A

United States Patent [19]

Cox

[11] Patent Number: 5,934,391

[45] Date of Patent: Aug. 10, 1999

[54] SONDE HOUSING DOOR HOLD-DOWN SYSTEM

[75] Inventor: David M. Cox, Crowley, Tex.

[73] Assignee: Railhead Underground Products, L.L.C., Springtown, Tex.

[21] Appl. No.: 08/968,255

[22] Filed: Nov. 12, 1997

Related U.S. Application Data

[60] Provisional application No. 60/040,747, Feb. 5, 1997.

[51] Int. Cl.[6] ..... E21B 10/62

[52] U.S. Cl. ..... 175/73; 175/325.5

[58] Field of Search ..... 175/19, 65, 73–76, 175/325.5

[56] References Cited

U.S. PATENT DOCUMENTS

| | | |
|---|---|---|
| 2,704,204 | 3/1955 | Koontz . |
| 4,867,255 | 9/1989 | Baker et al. . |
| 4,989,681 | 2/1991 | Lohmüller . |
| 5,052,503 | 10/1991 | Löf . |
| 5,148,875 | 9/1992 | Karlsson et al. . |
| 5,163,520 | 11/1992 | Gibson et al. . |
| 5,253,721 | 10/1993 | Lee . |
| 5,469,926 | 11/1995 | Lessard . |
| 5,484,029 | 1/1996 | Eddison . |

OTHER PUBLICATIONS

"Brochure for Barbco Directional Tooling", Barbco, Inc., Undated.

"Brochure for Straightline Directional Tooling—Training Seminar", Straightline Directional Drilling Systems, Jun. 14, 1996.

*Primary Examiner*—Roger Schoeppel

*Attorney, Agent, or Firm*—Daniel V. Thompson

[57] ABSTRACT

A sonde housing for horizontal directional drilling includes a cylindrical housing body with walls defining a longitudinal cavity, a cover for the cavity, and a hold-down means for attaching the cover to the housing body.

6 Claims, 2 Drawing Sheets

SONDE HOUSING DOOR HOLD-DOWN SYSTEM

CROSS-REFERENCE TO RELATED APPLICATION

This is a continuation-in-part of Provisional Patent Application No. 60/040,747, filed Feb. 5, 1997.

TECHNICAL FIELD

The present invention relates to earth drilling, and more particularly to horizontal directional drilling.

BACKGROUND ART

Directional drilling systems are primarily applicable to horizontal directional drilling, and more specifically to earth and rock formation boring. In lateral or horizontal directional drilling, it is often necessary to bore or drill through an earth-bound formation, such as rock, and with the bit still remaining directable. This industry, sometimes called "trenchless digging," installs utilities around immovable objects, such as roadways, rivers and/or lakes, etc.

The conventional boring technique traditionally operates from a boring device or machine that pushes and/or rotates a drill string consisting of a series of connected drill pipes with a directable drill bit to achieve an underground path or direction through which a conduit or utility device can be installed. A sonde immediately follows the drill bit as it is directed around, over or under obstructions. The sonde transmits electronic positioning signals to a worker vertically above the sonde by way of a hand-held complementary receiving device.

A drawback of pre-existing sondes for horizontal drilling systems is a simple bolted-on cover for a sonde housing that is not robust enough to withstand the rigors of the horizontal directional drilling environment, especially when drilling through hard formations such as rock, where substantial vibration is incurred.

SUMMARY OF THE DISCLOSURE

My directional earth boring system for boring all earth formations such as dirt, sand, rock or any combination of formations, utilizes a sonde housing having specially-adapted hold-down structure for a cover.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE PREFERRED EMBODIMENT

Figure 1:
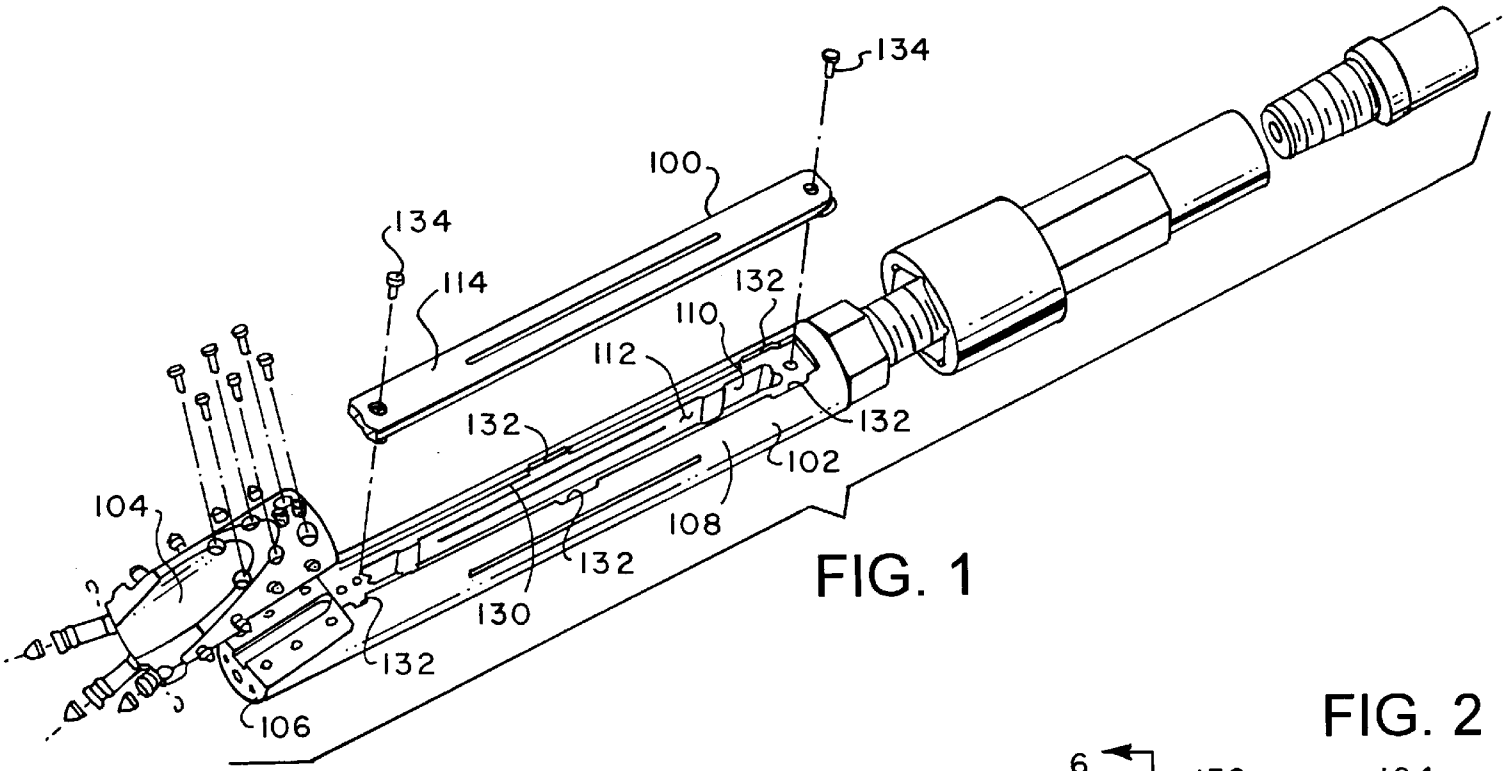
FIG. 1 is an exploded perspective view of a bit and sonde housing utilizing the cover hold-down system of the present invention.

Referring to FIGS. 1 through 6, where like numerals indicate like and corresponding elements, the apparatus of the present invention is a hold-down system for a cover 100 attached to a sonde housing 102 for horizontal directional drilling. A bit 104 for horizontal directional drilling is attached to the front end 106 of sonde housing 102.

Sonde housing 102 includes a cylindrical housing body 108 with walls 110 defining a longitudinal cavity 112. A cover 114 for the cavity 112 is provided with hold-down means for attaching the cover to the housing body.

Figure 2:
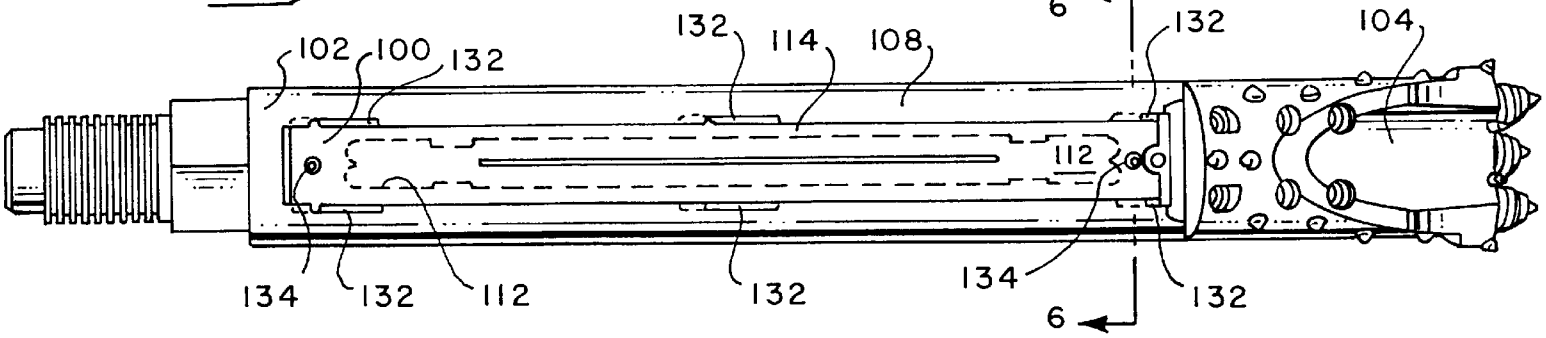
FIG. 2 is a top view of the bit and sonde housing of FIG. 2.
Figure 3:
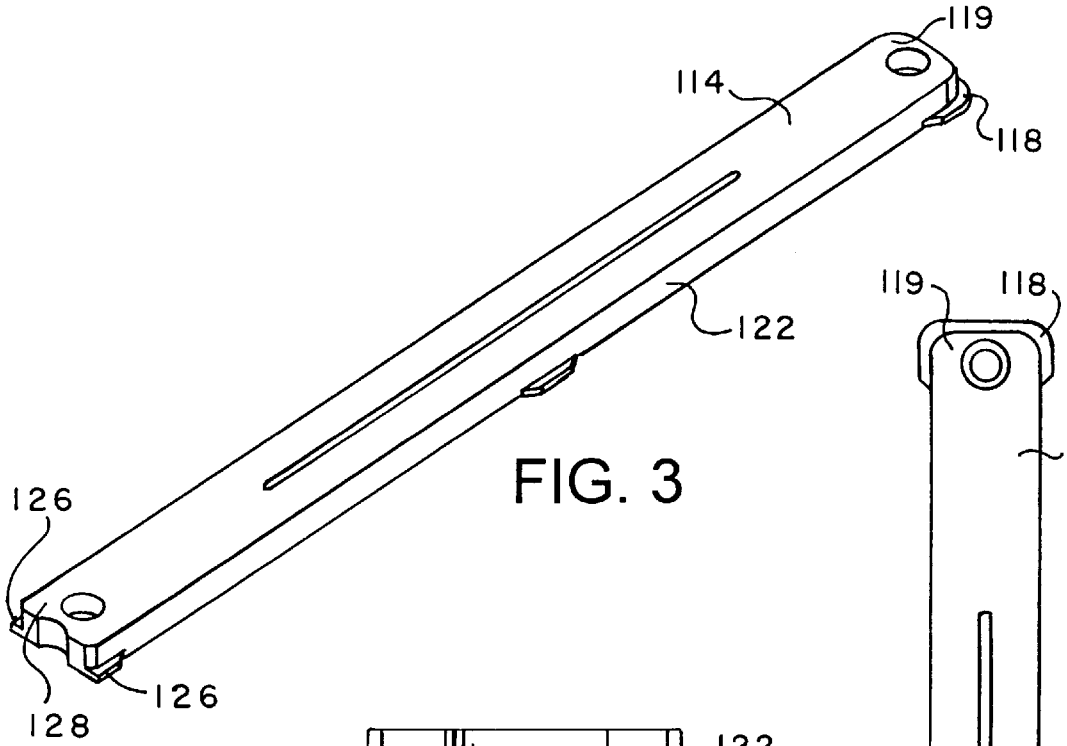
FIG. 3 is a perspective view of a cover for the sonde housing.
Figure 4:
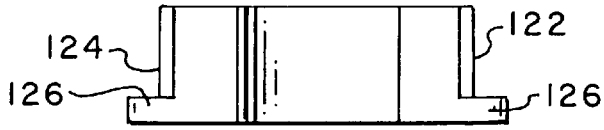
FIG. 4 is an end view of the cover of FIG. 3.
Figure 6:
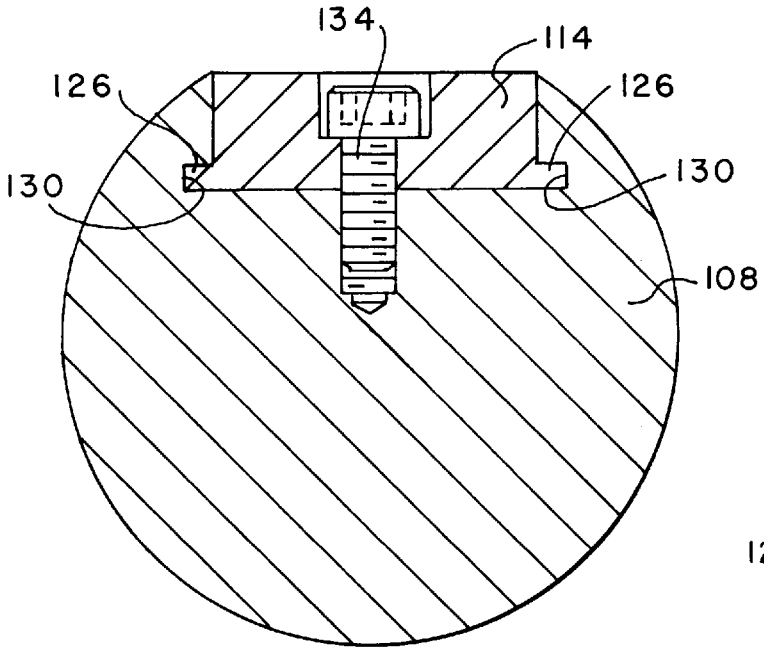
FIG. 6 is a section view taken along lines 6—6 of FIG. 2.
Figure 5:
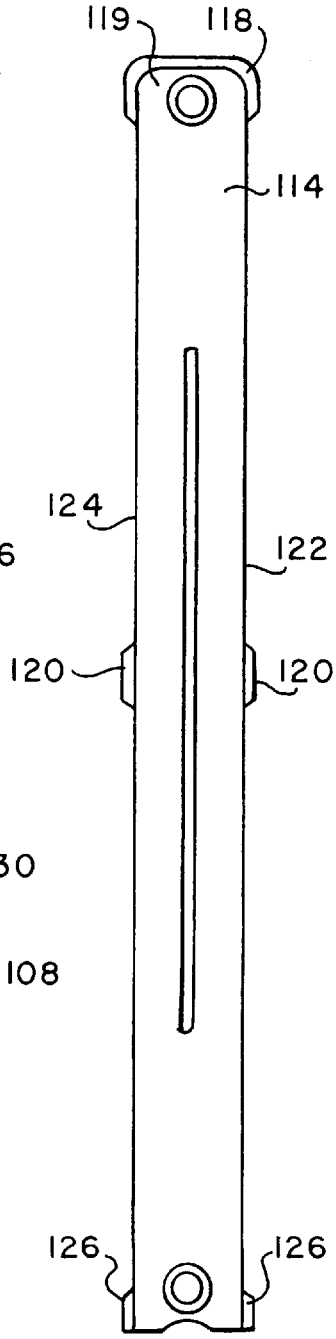
FIG. 5 is a top view of the cover of FIG. 3.

The hold-down means includes a plurality of tabs extending from the cover and mating grooves in the sonde housing for slidably engaging the tabs. The tabs include a continuous end tab 118 at one end 119, two intermediate tabs 120 on opposite sides 122, 124 of the cover 114 at approximately the midpoints thereof, and two partial end tabs 126 on opposite sides 122, 124 of the cover 114 at the end 128 opposite end 119. Two continuous lateral grooves 130 mate with tabs 118, 120, 126, but have upper open portions 132 to permit vertical pass-through of the tabs. Tabs 118, 120, 126, grooves 130, and open portions 132 are adapted and arranged to permit vertical engagement when the cover 114 is longitudinally displaced with respect to the cavity 112 and permit longitudinal sliding engagement to a fully engaged position, as shown in FIG. 2, after cover 114 and housing body 108 have been vertically engaged. After full engagement, threaded fasteners 134 are applied to prevent sliding out of engagement, but the primary loads are taken by the tabs and grooves.

In operation, the cover is installed by vertically engaging the tabs with the open portions of the grooves, then longitudinally sliding the cover to its fully engaged position. Installing fasteners 134 completes the installation.

Whereas, the present invention has been described with respect to a specific embodiment thereof, it will be understood that various changes and modifications will be suggested to one skilled in the art, and it is intended to encompass such changes and modifications as fall within the scope of the appended claims.

I claim:

1. A sonde housing for horizontal directional drilling, comprising: a cylindrical housing body with walls defining a longitudinal cavity;

a cover for the cavity;

hold-down means for attaching the cover to the housing body; and where the hold-down means includes a plurality of tabs extending from the cover and mating grooves in the sonde housing for slidably engaging the tabs.

2. The housing of claim 1 where the tabs and grooves are adapted and arranged to permit vertical engagement when the cover is longitudinally displaced with respect to the cavity and permit longitudinal sliding engagement to a fully engaged position when the cover and housing have been vertically engaged.

3. The housing of claim 2 where the hold down means further includes a plurality of threaded fasteners engaging the cover and housing body to prevent the cover from sliding out of engagement with the grooves when the cover is fully engaged, such that the primary loads on the cover are taken by the tabs and grooves.

4. A sonde housing for horizontal directional drilling, comprising: a cylindrical housing body with walls defining a longitudinal cavity;

a cover for the cavity;

hold-down means for attaching the cover to the housing body;

where the hold-down means includes a plurality of tabs extending from the cover and mating grooves in the sonde housing for slidably engaging the tabs, the tabs including a continuous end tab at one end of the cover, at least two intermediate tabs on opposite sides of the cover, and two partial end tabs at an opposite end of the cover; and where the tabs and grooves are adapted and arranged to permit vertical engagement when the cover is longitudinally displaced with respect to the cavity and permit longitudinal sliding engagement to a fully engaged position after the cover and housing have been vertically engaged.

5. The housing of claim 4 with two intermediate tabs at approximately the midpoints of the cover.

6. The housing of claim 4 where the hold down means further includes a plurality of threaded fasteners engaging the cover and housing body to prevent the cover from sliding out of engagement with the grooves when the cover is fully engaged, such that the primary loads on the cover are taken by the tabs and grooves.

* * * * *